US005351939A

United States Patent [19]

Kremer et al.

[11] Patent Number: 5,351,939

[45] Date of Patent: Oct. 4, 1994

[54] MACHINE FOR PIERCING A TAPHOLE FOR A SHAFT FURNACE

[75] Inventors: Victor Kremer, Luxembourg; Emile Lonardi, Bascharage; Guy Thillen, Diekirch, all of Luxembourg; Philippe Malivoir, Thionville, France

[73] Assignee: Paul Wurth S.A., Luxembourg

[21] Appl. No.: 80,145

[22] Filed: Jun. 17, 1993

[30] Foreign Application Priority Data

Jun. 17, 1992 [LU] Luxembourg ..... LU 88 135
Sep. 2, 1992 [LU] Luxembourg ..... LU 88 167

[51] Int. Cl.[5] ..... C21B 7/12
[52] U.S. Cl. ..... 266/271; 266/45
[58] Field of Search ..... 266/45, 271, 272, 273; 254/29 R; 269/234, 254 CS

[56] References Cited

U.S. PATENT DOCUMENTS 2,705,630 4/1955 Taddeo ..... 266/271
4,893,794 1/1990 Mailliet et al. ..... 226/271
5,069,430 12/1991 Woodings et al. ..... 266/271
5,192,489 3/1993 Metz et al. ..... 266/271

FOREIGN PATENT DOCUMENTS 0064644 11/1982 European Pat. Off. .
0379018A3 9/1991 European Pat. Off. .
0519397 12/1992 European Pat. Off. ..... 266/271
3111260A1 9/1982 Fed. Rep. of Germany .
1633251 3/1991 U.S.S.R. ..... 266/271
2116898A 10/1983 United Kingdom .
2216827A 10/1989 United Kingdom .

*Primary Examiner*—Scott Kastler
*Attorney, Agent, or Firm*—Fishman, Dionne & Cantor

[57] ABSTRACT

A machine for piercing a taphole for a shaft furnace in the so called "lost rod" method is presented. After the taphole is blocked with a taphole clay but before the taphole clay has fully hardened, a piercing rod is driven into the taphole clay by this machine so that at the desired time the taphole can be opened by extracting the piercing rod by this same machine. This piercing machine comprises a mounting, a first carriage which can be displaced along the mounting, a drive mechanism for this first carriage, guide mechanism to guide the piercing rod and finger mechanism capable of exerting axial thrust upon the piercing rod. The guide means define a guide channel for the piercing rod, which guide mechanism also has a longitudinal opening that gives access to the inside of the guide mechanism, the guide channel being perpendicular to the axis of the longitudinal opening. A finger that has the ability to exert an axial thrust on one end of the piercing rod penetrates through the longitudinal opening inside the guide channel.

18 Claims, 9 Drawing Sheets

MACHINE FOR PIERCING A TAPHOLE FOR A SHAFT FURNACE

BACKGROUND OF THE INVENTION

This invention relates generally to a machine for piercing a taphole for a shaft furnace. More particularly, this invention relates to a machine used for piercing a taphole for a shaft furnace related to the so-called "lost rod" method used for piercing a taphole for a shaft furnace used in the production of steel. The lost rod method comprises blocking the taphole with taphole clay. Before the taphole clay has fully hardened, a metal rod is driven into and through this clay to a desired depth into the shaft furnace. At the appropriate time, the metal rod is extracted to open the taphole using a piercing rod machine. In accordance with this invention, such a piercing rod machine comprises a mounting which can be oriented in front of the shaft furnace wall in a working position in the extension of the axis of the taphole, a carriage which can be displaced along the mounting and a drive means to drive the carriage along the mounting.

The prior art teaches how to use conventional piercing machines, designed for working with a drill bit, for piercing tapholes with the lost rod method. These machines include a chuck fitted with a coupling means for the rod along with a powerful two-directional pneumatic hammer for supplying the force necessary for inserting and extracting the piercing rod.

A powerful pneumatic hammer of the type used on these piercing machines has its problems. The hammer exerts considerable stresses and vibrations on the equipment and, particularly, on the coupling means connecting the piercing rod to the working member resulting in rapid wear of the coupling means. In addition, the pneumatic hammer is extremely noisy and often does not conform to the ever-stricter standards aimed at reducing the noise level in the industrial environment. These disadvantages of the pneumatic hammer make it desirable to eliminate the percussion (or noise level) of the hammer during insertion and extraction of the piercing rod.

The prior art teaches a method for extracting the piercing rod using a powerful drive means coupled firmly to the free end of the piercing rod. This method uses a forceful recoil movement to withdraw the piercing rod from the taphole without producing vibrations and is completely silent. This extraction method has been tried on various machines and produces entirely satisfactory results. The drive means on these machines are either jacks or hydraulic motors and use special clamps as means for coupling the drive means to the piercing rod.

Unfortunately, such a silent "forceful" solution is not available for the operation of inserting the piercing rod into the hardening taphole clay. In fact, given the dimensions of the piercing rod (a normal piercing rod has a length of 4 m and a diameter of 4 cm) a powerful axial thrust risks (1) causing the rod to buckle and (2) that the piercing rod may be permanently blocked in a position in which the rod is partially driven into the rapidly hardening clay.

A proposed method to resolve the aforementioned problems during the "forceful" insertion operation was used comprising intermediate guides fastened on the mounting and circumferentialy encircling the piercing rod at several points and to put these guides successively, in step with the advancement of the clamp toward the front of the mounting, in a position which does not hinder the forward travel of the clamp. Slidable guides were installed on the mounting. These guides are thrust forward by the forward travel of the clamp into a position at the front of the mounting. However, this solution had certain problems. For one thing, these sliding intermediate guides constitute very vulnerable elements. Considering the rough working conditions to which a piercing machine is subjected, the guides risk becoming blocked in their guide rails and, thus, constitute an obstacle to the forward travel of the clamp. In addition, the arrangement of a parked position at the front of the mounting for these intermediate guides not only constitutes an obstruction problem at the front of the mounting, but also subjects these intermediate guides to the splashes coming from the jet of molten metal from the taphole. Also, practical experience has shown that the buckling of the piercing rod between two successive supports is not totally precluded. A piercing machine which makes it possible to drive a piercing rod into the semi-hardened taphole clay using a powerful force to the free end of the piercing rod without buckling as well as resolving the other problems discussed is required.

SUMMARY OF THE INVENTION

The above-discussed and other drawbacks and deficiencies of the prior art are overcome or alleviated by the machine for piercing a taphole for a shaft furnace of the present invention. The present invention provides a machine for piercing a taphole for a shaft furnace comprising guide means for defining a guide channel for the piercing rod; support means to support the guide means on the mounting; and finger means integral with the first carriage means to exert an axial thrust on one end of the piercing rod so as to advance the piercing rod into the taphole clay without buckling the piercing rod.

Preferably, the guide means has at least one longitudinal opening which gives access to the inside of the guide channel perpendicularly to the axis of the guide means.

The support means is preferably constructed so that the longitudinal axis of the guide channel is coaxial with the axis of the taphole when the mounting is located in the working position in front of the wall of the shaft furnace to facilitate the insertion of the piercing rod.

The finger is preferably sized so as to penetrate through the longitudinal opening to the inside of the said guide channel so that the finger can exert an axial thrust on one end of the piercing rod during the advancement of the first carriage in the direction of the taphole.

In accordance with the present invention, the piercing rod slides in the guide channel. The longitudinal opening of the guide channel allows the finger which is integral with the carriage to be driven along the mounting behind the free end of the piercing rod by the powerful drive means. The guiding of the piercing rod in this channel prevents buckling of the piercing rod when an appreciable axial thrust is applied to the free end of the piercing rod. The thrust is provided by the integral finger which extends into the longitudinal opening of the guide channel. The guide channel prevents the buckling of the piercing rod as the piercing rod is driven into the taphole clay previously placed in the taphole. The guide means is sized so as not to allow a radial escape of the piercing rod from the guide channel. Note that the guide channel may have axial and radial discontinuities as long as there is no risk of radial escape of the piercing rod when subjected to the axial thrust.

An important advantage of the piercing rod machine of the present invention is that this machine can insert the piercing rod into the taphole clay safely (without buckling) by exerting a powerful force on the piercing rod's free end. There is, therefore, no need to use a noisy hammer power source which inherently imposes significant stresses and vibrations on the equipment and on the piercing machine.

The guide channel in accordance with the present invention does not have to be removed in step with the forward travel of the finger which is integral with the carriage of the piercing rod machine. This carriage can be displaced along the mounting. This is in contrast to the aforementioned solution of sliding intermediate guides. It will be appreciated that in accordance with the present invention, the only element that is moveable is the carriage which supports the integral finger penetrating inside the guide channel. The guide means defining the guide channel of the piercing rod in no way hinders the forward travel of the finger which is integral with the displaceable carriage and may therefore remain in place during the entire operation of inserting the piercing rod.

The guide means could, however, still be a hindrance during the operation for extracting the rod using a conventional clamp, or even when it is desired to work with a conventional drill which can be displaced along the mounting so as to drill the taphole with a drill bit. This is why it is advantageous to support the support means by means of arms which are articulated onto the mounting. This solution makes it possible to pivot the guide means laterally, freeing, if need be, the clearance space necessary along the mounting so as to extract the rod with the aid of a conventional clamp, or even for working with a drill which can be slid along the mounting. This pivoting or folding-down of the guide means into a lateral position with respect to the mounting additionally has the advantage of removing the guide means from the most dangerous zone facing the taphole, which zone is naturally the one which is located directly in the extension of the axis of the jet when the taphole is open.

In accordance with a preferred embodiment of the present invention, the guide channel for the rod is defined by a tube having a diameter which is slightly greater than that of the rod and fitted with at least one longitudinal slit passing radially through its wall along a generatrix along its entire length. It involves a particularly simple and inexpensive embodiment of the guide means. The longitudinal slit allows the finger to penetrate inside the tube so that it can exert an axial thrust on the end of the rod during the forward travel of the carriage along the mounting in the direction of the taphole.

The metal piercing rod may naturally be loaded axially into the guide channel by inserting the rod in via one end of the channel. The insertion of the rod is, however, facilitated when the guide means may be opened longitudinally so as to freely place the rod in the guide channel. To this end, the guide means may, for example, be made up of longitudinal components which are juxtaposed so as to define, together, the guide channel.

In a preferred embodiment, the tube serving as guide means is split longitudinally into a first and second tube segment. In this way, the tube may be opened longitudinally in order to place therein the metal piercing rod, and closed again so as to form the guide channel. The first tube segment is then mounted on the first arms which are articulated along the first lateral side of the mounting, and the second tube segment is mounted on second arms which are articulated along the opposite lateral side of the mounting. This assembly makes it possible to pivot the first tube segment and the second tube segment laterally in opposite directions so as to open the channel. In the open position of the channel it is then easy to place the metal piercing rod in one of the two tube segments, then to close the guide channel by pivoting the two tube segments into their initial positions. It should be noted that this assembly also makes it possible to release a certain clearance between the two tube segments. This clearance may be necessary for the passage of a clamp or of a drill which is displaceable on the mounting.

The pivotable support means can be actuated by one or more jacks. The jack or jacks then hold the guide channel in the axis of the taphole during the operation of driving the piercing rod into the taphole clay and make it possible to fold the guide means down when the guide means is not used. The jacks may be mounted in a protected zone of the mounting and thus be effectively protected against splashes.

The drive means must be capable of exerting sufficient force by means of the integral finger of the first carriage on the free end of the piercing rod to drive the other end of the piercing rod through the hardening taphole clay in the taphole. This force is exerted via the carriage along the mounting in the direction of the taphole.

In a preferred embodiment of the piercing machine, this drive means comprises an endless chain which is driven by a hydraulic motor. It involves a particularly simple drive means which can, however, deliver appreciable drive forces. In addition, the chain is self-cleaning and does not require undue maintenance.

It will be noted that the piercing machine can be fitted with a working member comprising a drill and possibly a powerful hammer. The possibility of being able to work with a normal drill bit on this machine is thus retained. This may be useful for reforming or displacing the taphole, or for working with a conventional drill bit when the lost-rod method cannot be used for one reason or another. In this case it is preferable to provide means for coupling the working member to the drive means of the first carriage. In this way the necessity to install a second drive system on the machine is avoided.

To extract the metal rod from the taphole, when it is desired to open the taphole, the drive means of the first carriage may be used. This drive means must, therefore, be capable of exerting a significant force in the direction for extracting the rod. The piercing machine, in this case, comprises means for firmly coupling the free end of the rod to the drive means. The drive means withdraws the rod from the taphole using a forceful recoil movement without producing vibration and is completely silent. The coupling means used for extracting the rod may, for example, comprise a hook which is mounted on the first carriage. This hook then engages through the longitudinal opening of the guide channel so as to bear behind a shoulder machined into the free end of the piercing rod. The foregoing arrangement makes it possible to exert a tensile force on the rod and, thus, withdraw it, in step with the recoil movement of the carriage on the mounting, through the guide channel and out of the taphole. It is also possible to work with several hooks engaging through several longitudinal openings distributed around the guide channel. This embodiment makes it possible to reduce the contact pressure to be withstood by the shoulder machined into the piercing rod.

Alternatively, to free the piercing rod from the taphole it is also possible, however, to fold the guide means down into a lateral position with respect to the mounting. In this case sufficient clearance space is available on the axis of the piercing rod to use any means which makes it possible to couple the end of the rod firmly to the drive means so as to apply sufficient traction force on it. Such means are, for example, clamps with jaws such as are described in the British Patent GB 2,116,898, all of the contents of which are incorporated herein by reference; it being possible for chucks with a female screw thread to be screwed onto a male screw thread machined in the free end of the piercing rod, chucks with transverse keys interacting with a flat machined on the end of the rod, etc.

It will also be appreciated that the present machine comprises, in a preferred embodiment, an intermediate support sliding on and displaceable along the mounting, making it possible to support a rod or a drill bit in the absence of the guide channel.

A screen mounted at the front of the mounting protects the machine effectively against splashes coming from the jet leaving the taphole.

The above-discussed and other features and advantages of the present invention will be appreciated and understood by those of ordinary skill in the art from the following detailed discussion and drawings:

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
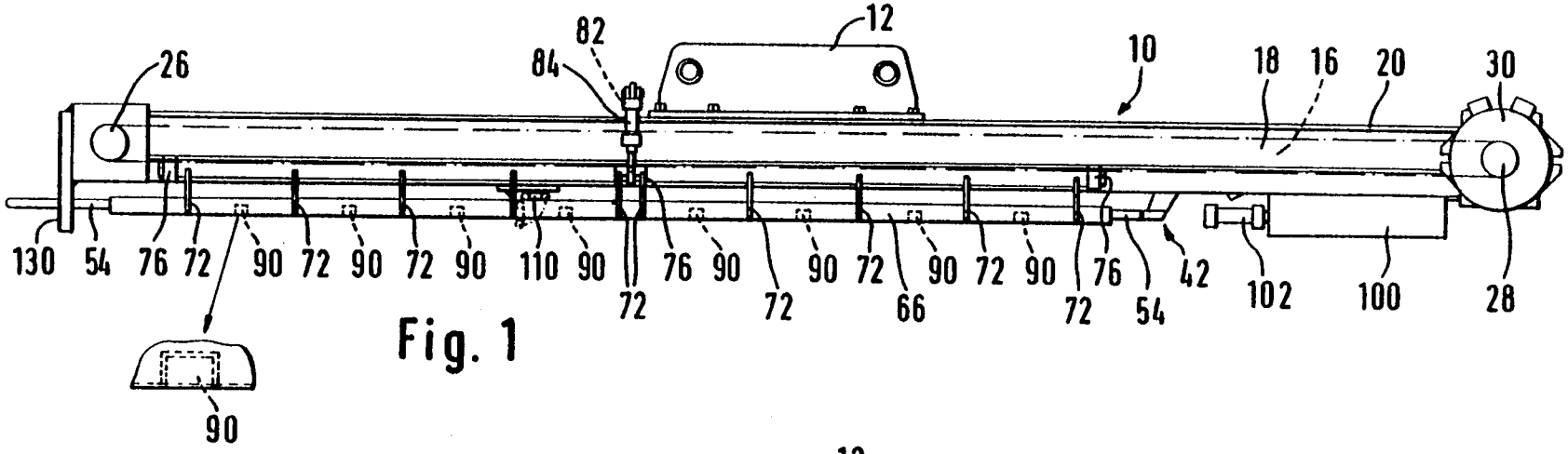
FIG. 1 shows, in front elevation view, the mounting of a piercing machine in accordance with the present invention.

For the description of the whole machine, refer first to FIGS. 1 find 2. These two FIGURES show a mounting 10 of a piercing machine. This mounting 10 is, for example, supported at the end of a carrying arm (not shown) via a central component 12 integral with the mounting 10. This carrying arm may pivot in a conventional and known way about a bracket (not shown) so as to displace the mounting between a parked position and a working position and vice versa. In this working position the mounting 10 may be oriented in front of the wall of the furnace so that its longitudinal axis is located in the extension of the axis of the taphole.

The mounting may, for example, be formed of several beams or metal profiles welded together so as to form a sort of box structure. This box structure 14 (see FIG. 3) includes two lateral walls 16, 18 connected by an upper metal sheet 20 and delimiting a longitudinal opening 22 (see FIG. 5) downwards. In the box structure 14 there is mounted at least one endless chain 24. This endless chain 24 is tensioned between a driven sprocket 26 mounted at the front of the mounting 10 and a driving sprocket 28 mounted at the back of the mounting 10. The driving sprocket 28 is driven by at least one motor 30 fixed onto the mounting 10, preferably a hydraulic motor whose direction of rotation may be reversed by means of a suitable control system.

Figure 4:
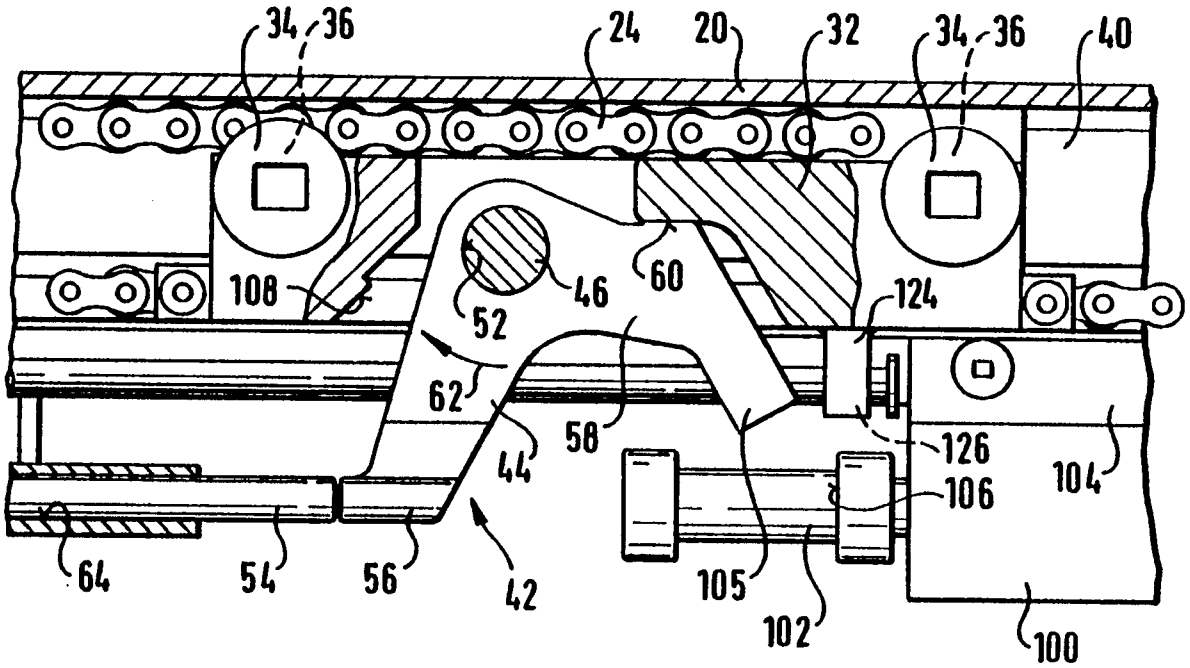
FIG. 4 shows a longitudinal section through the first carriage supporting the finger.

Inside the box structure 14 there slides a first carriage 32 which is driven by the endless chain 24. This first carriage 32 is shown in more detail in FIG. 4. Carriage 32 includes, on each side, a pair of rollers 34, 36 which are respectively guided in a first rail 38 and in a second rail 40. These rails 38, 40, which have a U-shaped cross-section (see FIG. 5), form an integral part of the lateral walls 16, 18 of the box structure 14.

On the carriage 32 there is mounted a finger 42 including a flat trunk 44 which extends the carriage 32 downwards through the longitudinal opening 22 into the box structure 14 forming the mounting 10. This finger 42 is preferably mounted in the carriage 32 with the aid of a cylindrical pin 46 housed in bores 48, 50 of the carriage 32 and passing though a bore 52 of the trunk 44, so as to be able to pivot in the vertical plane passing through the axis of displacement of the first carriage 32.

Figure 2:
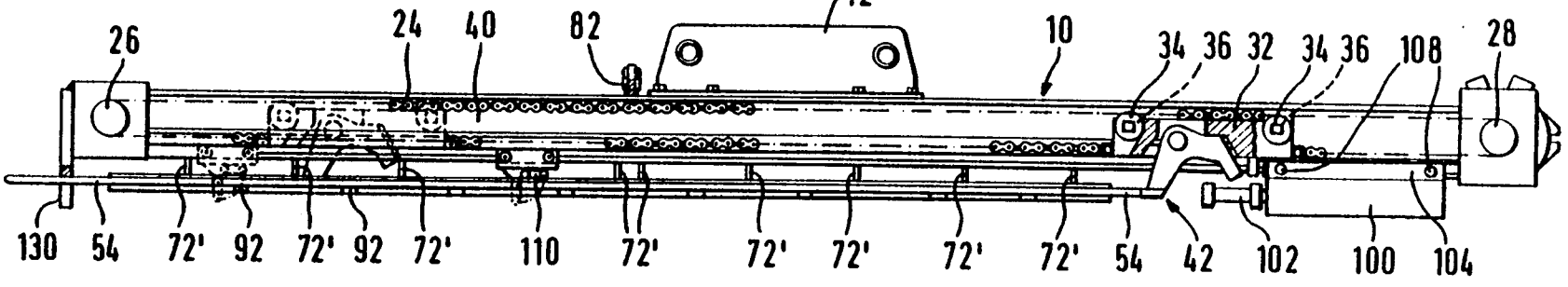
FIG. 2 shows a longitudinal section through the mounting of FIG. 1.
Figure 5:
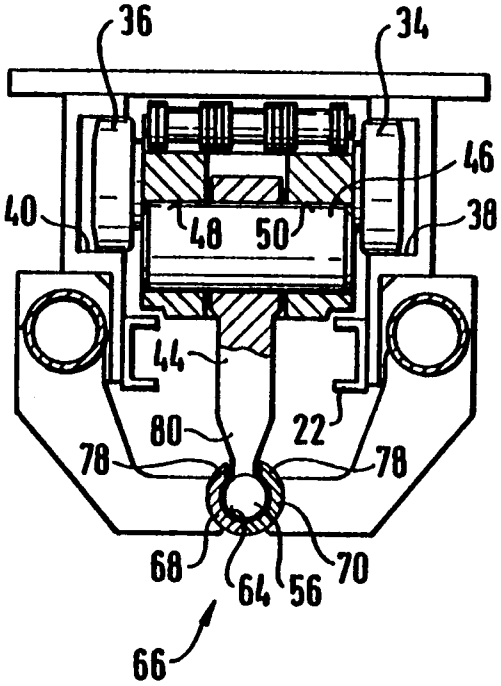
FIG. 5 shows a transverse section through the first carriage supporting the finger.

In FIG. 2 as well as in FIG. 5 the finger 42 is shown in a position in which it bears via its lower end on a piercing rod 54. The latter has been installed in the piercing machine so as to be driven into a taphole clay which has previously been injected into the taphole. The lower end of the finger 42 which bears on the rod 54 has the shape of a cylindrical heel 56 which extends in the extension of the axis of the rod 54. It will be noted that the finger 42 has an extension 58 of its trunk 44 on the other side of the cylindrical pin 46. This extension 58 bears on a beating surface 60 of the first carriage 32 when the cylindrical heel 56 of the finger exerts an axial thrust on the end of the rod 54. In the position shown in FIG. 4 the finger 42 may then pivot solely in the clockwise direction, that is to say in the direction of the arrow denoted by the reference 62.

The rod is guided in a channel (>4 formed by a cylindrical tube 66. This tube 66, which is substantially the same length as the rod and has an internal diameter which is slightly greater than the diameter of the rod, is made up, preferably, of two tube segments 68, 70 which are almost symmetrical with respect to a plane passing through the longitudinal axis of the tube. Each of the two segments 68, 70 is supported by several bent arms 72, 74' (see FIG. 3). The bent arms 72 supporting the first tube segment 68 are spaced axially and fixed to a tube 74 running along the first lateral wall 16 of the box structure 14 forming the mounting (see FIGS. 1 and 3). This tube 74 is mounted, for example, at the middle and at its two ends, by means of cylindrical articulations 76 onto this first lateral wall 16, so that it can pivot about its longitudinal axis. The bent arms 72' supporting the second tube segment 70 are mounted identically along the opposite lateral wall 18 of the mounting 10. The elements participating in the mounting of the second tube segment 70 are denoted by the same reference numerals as the elements for mounting the first tube segment 68, provided, however, with a prime.

FIG. 5 shows the two tube segments 68, 70 in a position in which they are juxtaposed so as to form the guide channel (>4. In this position, the axis defined by the said guide channel (>4 is a straight line which is parallel to the direction of rolling of the first carriage 32. This axis is more precisely located in the median longitudinal plane of the first carriage 32.

The tube 66 formed by juxtaposition of the two tube segments 68, 70 is fitted with a longitudinal slit 78 passing radially through its wall, along a generatrix, over its entire length. In FIG. 5, it can be seen that this slit 78 points towards the longitudinal opening 22 in the mounting 10. In this way, the finger may penetrate, with its flat trunk 44, through the slit 78 to the inside of the tube 60, in which the heel 56 may slide freely when the first carriage 32 is displaced along the mounting 10. In the vicinity of the connection between the cylindrical heel 56 and the trunk 44 of the finger, the finger 42 has a restriction 80. This restriction 80 makes it possible to limit the width of the slit 78, so as to prevent the rod 56 from being able to jam in the slit 78 when the finger 42 exerts an axial thrust on the end of the rod 54.

When the rod 54 is driven into the taphole clay, it is thus guided over its entire length, except over the section extending between the wall of the shaft furnace and the front of the mounting 10. Now, the length of this non-guided section is much less than the critical length for which there is the risk of buckling. It is understood that the axial interruptions of the guide channel are no longer a hindrance, as long as the rod 56 can be forcefully driven into the taphole clay in complete safety without risking buckling at the points where the metal rod is not guided. To define the said guide channel 64 using a plurality of coaxial sleeves which are axially spaced by a distance less than the critical length for which there is a risk of buckling between two successive guide sleeves, for example, would not depart from the teaching of the present invention.

Figure 3:
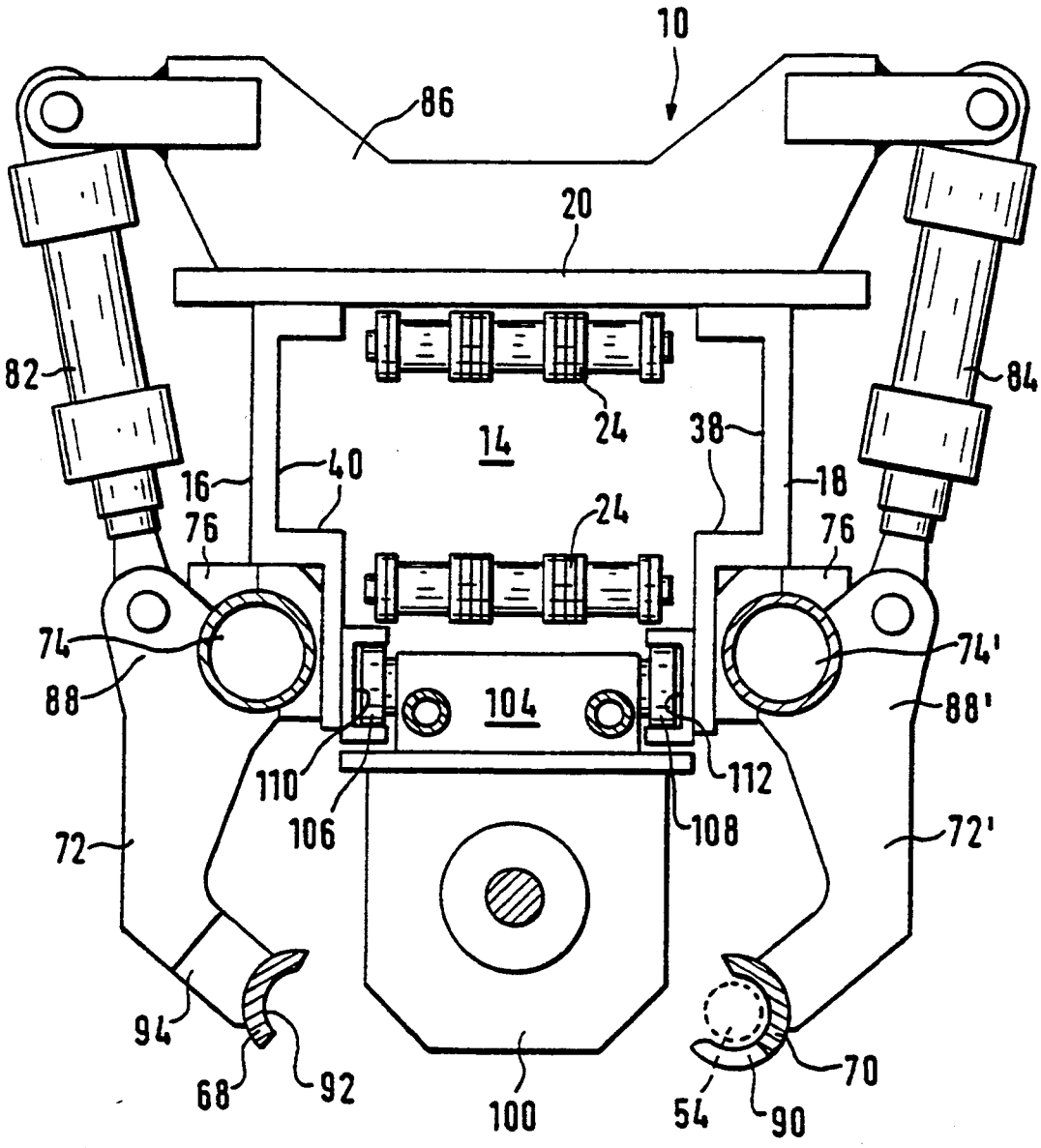
FIG. 3 shows a transverse section through the mounting of FIG. 1.

In FIG. 3 the two tube segments 68, 70, which define the channel 64 when they are juxtaposed against one another are shown away from one another. This arrangement is obtained by pivoting the tube 74, supporting, by means of the bent arms 72, the first tube segment 68, and pivoting the tube 74' supporting, by means of the bent arms 72', the second tube segment 70, about their respective axes and in opposite directions. This pivoting is produced by means of one or more jacks 82, 84.

In the embodiment represented in FIGS. 1 and 3, each of the tubes 74, 74' is fitted with its own jack 82, 84. These two jacks 82, 84 are arranged laterally to the mounting, at the midpoint of the tubes 74, 74' so as to be sheltered from splashes of molten metal sprayed out of the taphole when it is open. They may also be fitted with a protection cage (not shown) which in no way encumbers the mounting 10 at this point. Each of the two jacks 82, 84 is articulated according to the rules of the art with one of its ends on a support 86 integral with the mounting 10, and with the other end on a lever arm 88, 88' respectively integral with the first tube 74 or with the second tube 74'. In FIG. 3 the lever arm 88, 88' is an extension of a bent arm 72, 72'. It will be noted that an extension of the two jacks, 82, 84 gives rise to the two tube segments 68, 70 moving together until they meet in the region of the longitudinal median plane of the mounting 10. In this position, shown in FIG. 5, the two jacks push the two tube segments 68, 70 firmly against one another so as to define the guide channel 64.

A retraction of the two jacks 82, 84 gives rise to the two tube segments 68, 70 moving away from each other (see FIG. 3) and to the longitudinal opening of the channel 64 so that the rod 54 can easily be placed in one of the two tube segments. the rod 54 in FIG. 3 involves the right-hand segment 70, and is fitted with claws 90 for supporting the rod 54. These claws 90 are spaced axially, as shown in FIGS. 1 and 2, and, when the two tube segments 68, 70 are assembled, penetrate into corresponding notches 92 made in the other tube segment 68.

It will be appreciated that the two tube segments 68, 70 are components which can be produced at low cost, from longitudinally cut steel tubes. These tube segments are preferably fixed dismantleably to the bent arms 72, 72', for example with the aid of lugs 94 welded onto the tube segments and screwed onto the bent arms 72, 72'. Such a lug 94 is represented in the region of the left-hand arm 72 of FIG. 3. This assembly makes it possible to replace the tube segments 72, 72' easily if they are accidentally damaged at the front of the mounting 10 by the molten metal leaving the taphole.

In FIG. 3, it can be seen that the separation of the two tube segments 68, 70 frees a clear space below the mounting 10, which is sufficient for passing a working member 100. This working member 100 usually includes a drill and hammer. Its presence is justified so as to be able to drill, if needs be, a taphole using a conventional drill bit. Such may, for example, be the case when it is desired to reshape or displace the taphole, or when it is not possible to use the lost-rod method for one reason or another. The working member 100 is fitted with a chuck 102 which may be coupled to a drill bit. To this end, the finger 42 is pivoted upwards, that is to say in the direction of the arrow 62 of FIG. 4, so as to allow the drill bit to be inserted into the chuck. The tube segments 68, 70 are separated laterally so as to free the clearance necessary for the passage of the working member 100.

The working member 100 is mounted on a second carriage 104 which slides with the aid of two pairs of rollers 106, 108 in a pair of rails 110, 112 (see FIG. 3). The rails 110, 112 are fixed into the box structure 14 in parallel and below the rails 38, 40 supporting the first carriage 32. They have U-shaped cross-sections and are arranged so as to guide the second carriage vertically and laterally.

The working member 100 is driven by the same drive means as the first carriage 32. To this end, the second carriage 104 may, for example, be coupled by hooks (not shown) or any other equivalent means, to the first carriage 32.

It will be noted that the working member 100 may also be used for forcefully extracting the red, when it is fitted with suitable coupling means 102 for being coupled to the end of the rod 54 leaving the taphole. The first carriage 32 is then preferably fitted with a member which transmits the traction force directly to the said coupling means, so as to prevent the transmission of the traction force from taking place via the mechanism of the working member. This member may, for example, be a fork 105 integral with the said extension 58 of the finger 42 articulated to the first carriage 32 (see FIG. 4). When the rod 54 is extracted, the fork 105 then bears on a shoulder 106 of the coupling 102 mounted on the working member 100 so as to exert, on the working member 100, an axial thrust in the direction for extracting the rod 54. It will be noticed that in this position, the articulated finger 42 abuts against a bearing surface 108 of the first carriage 32. The working member 100 must not transmit any traction force, and serves solely as a sliding support for the coupling means 102.

Figure 8:
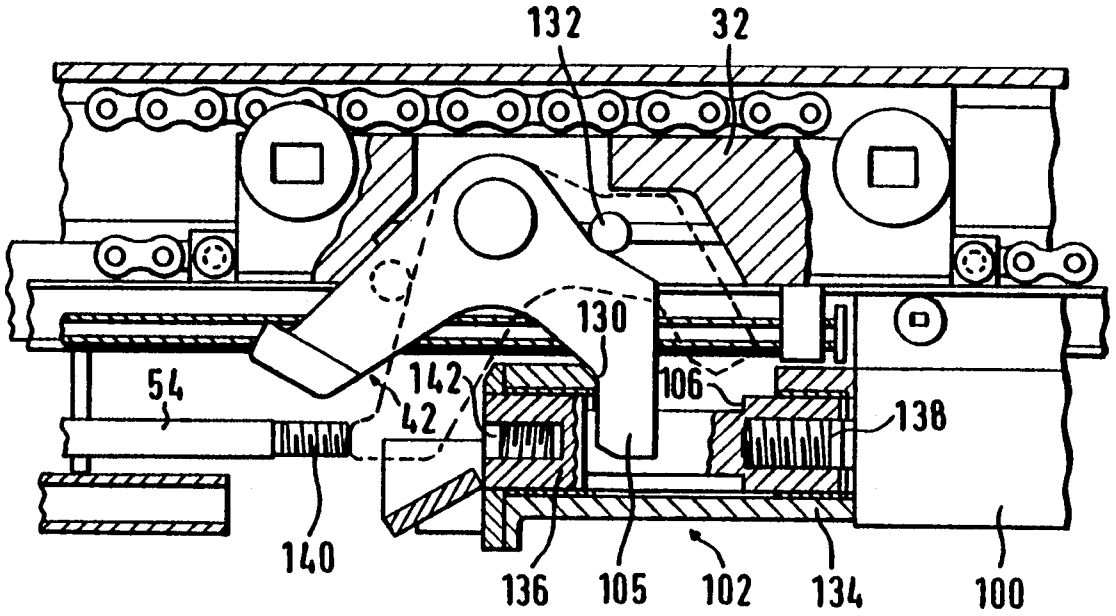
FIGS. 8 and 9 show, in views similar to FIGS. 4 and 5, how the first carriage supporting the finger may be used to drive the working member.
Figure 9:
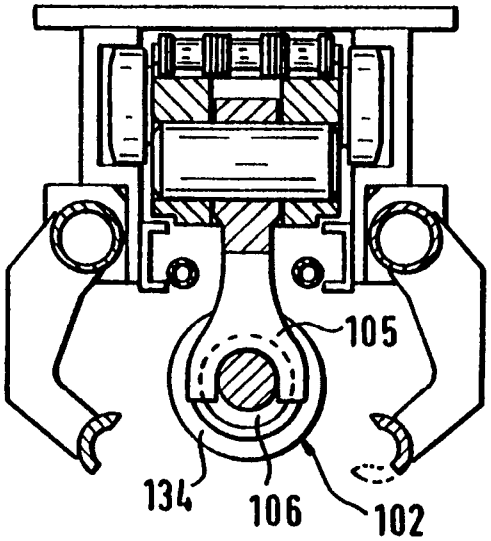
Figure 11:
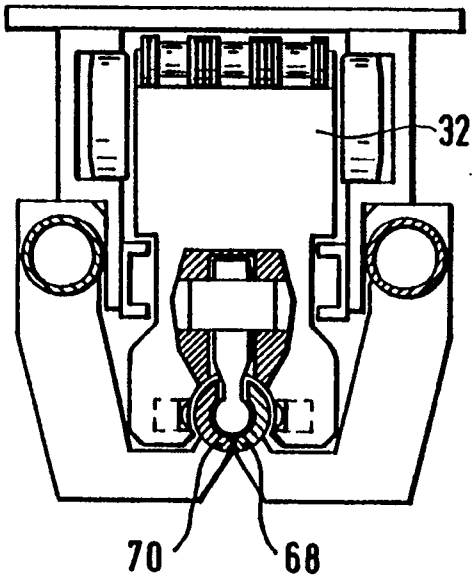
FIGS. 10 and 11 and respectively 12 and 13 show, in views similar to FIGS. 4 and 5, how a clamp with jaws for extracting the rod may be integrated into the first carriage supporting the finger.
Figure 10:
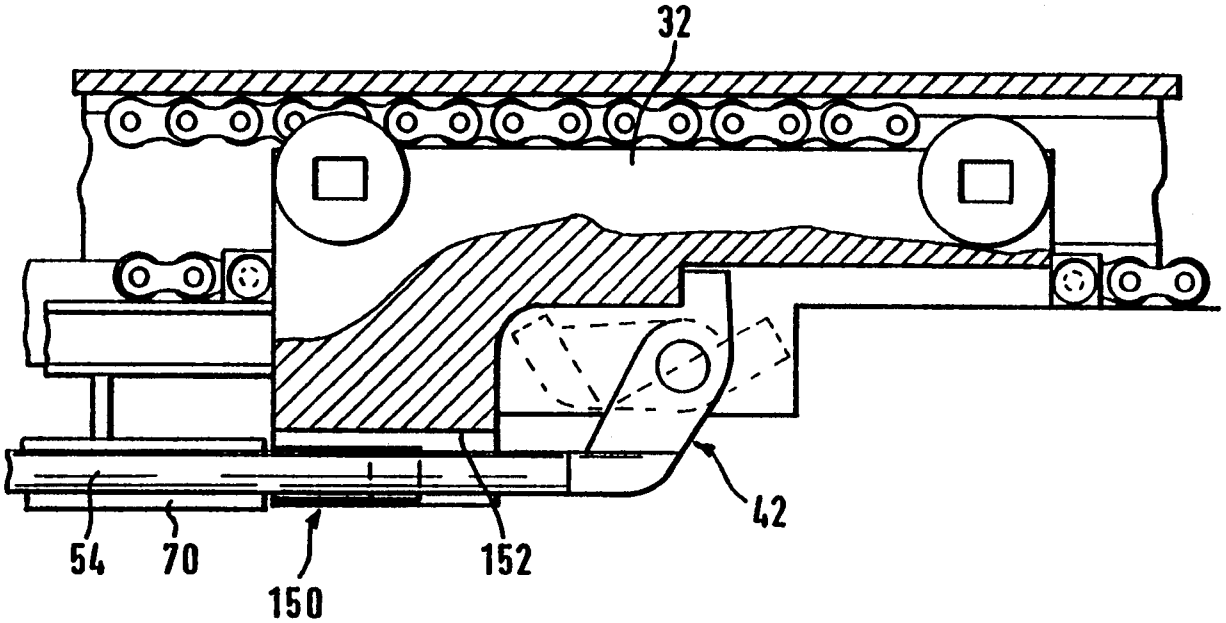
Figure 13:
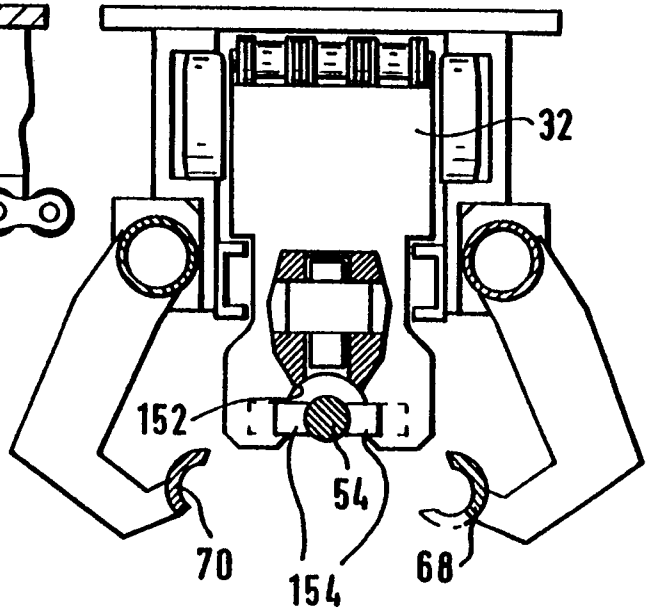
Figure 12:
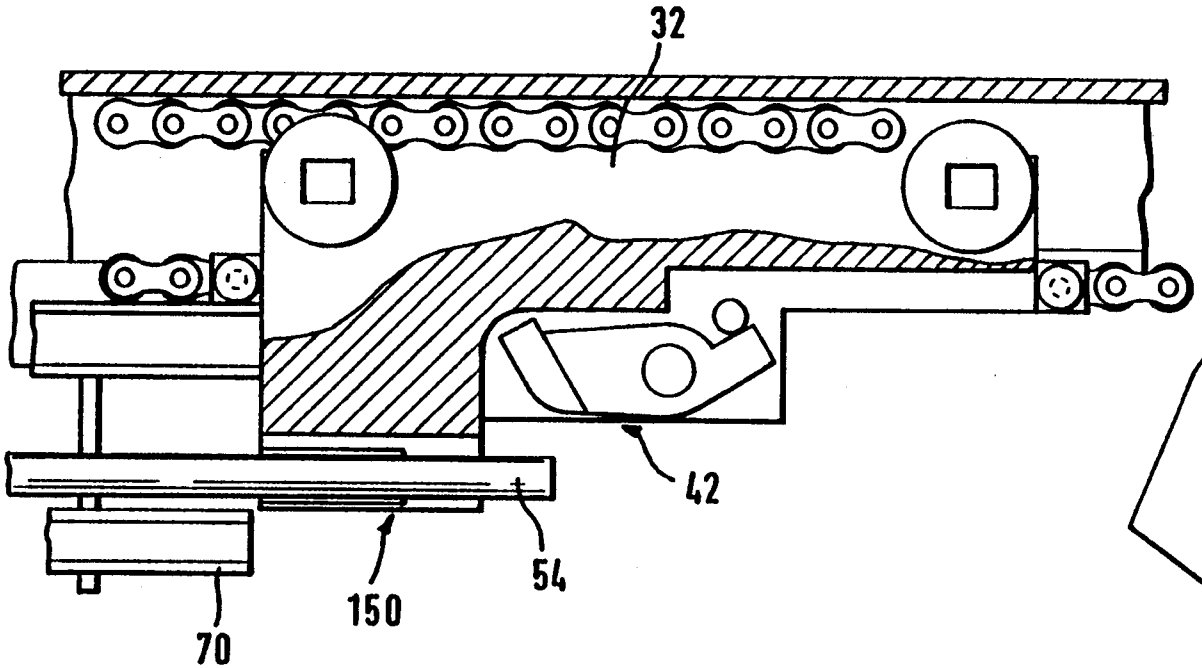
Figure 15:
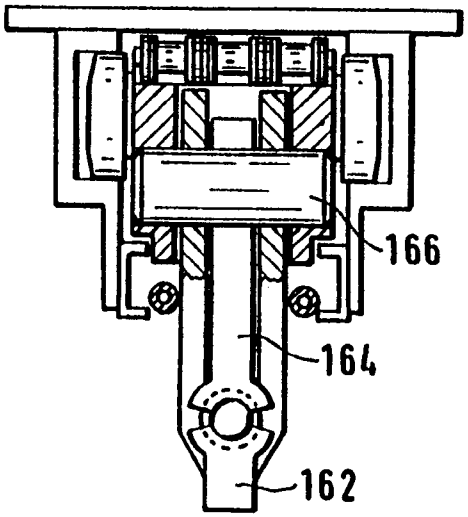
FIGS. 14 and 15, and respectively 16 and 17, show, in views similar to FIGS. 4 and 5, an alternative variant of a clamp with hooks for extracting the rod from the taphole.
Figure 14:
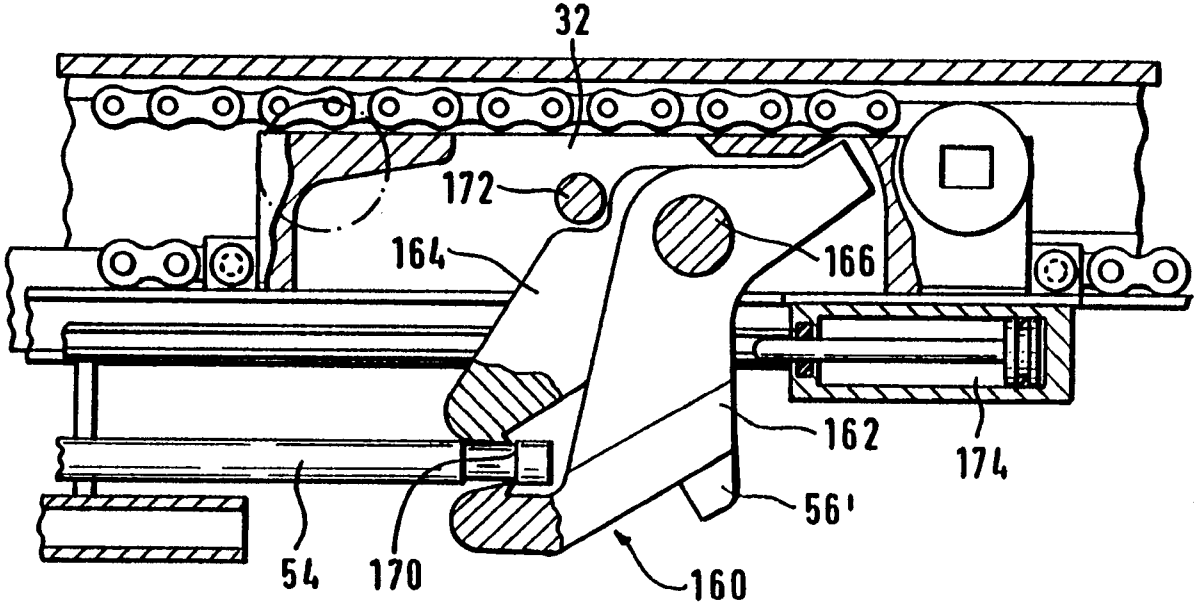
Figure 17:
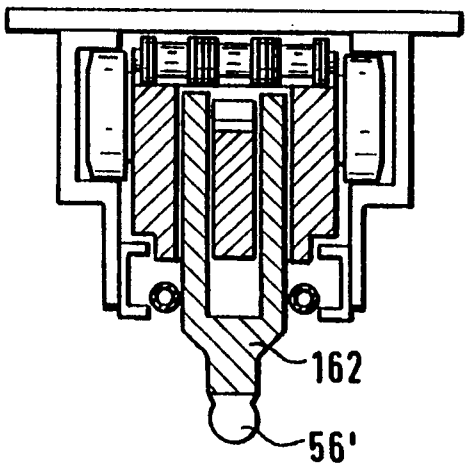

One variant for driving the working member 100 is shown in FIGS. 8 and 9. In FIG. 8 it can be seen that the fork 105, integral with the finger 42 articulated to the first carriage 32 is blocked by a transverse rod 132 in a vertical position between the shoulder 106 at the back of the coupling 102 and a second shoulder 130 at the front of the coupling 102. In this way the fork 106 bears on the front shoulder 130 so as to drive the working member 100, when the first carriage 32 is displaced towards the front of the mounting, in the same direction, and on the back shoulder 106 so as to thrust the working member 100 in front of it, when the first carriage is displaced towards the back of the mounting.

FIG. 8, moreover, shows that the coupling 102 comprises a cage 134 integral with one end of the chassis of the working member 100. In this cage there may freely turn a rotary member 136 integral with a drive spindle 138 of the working member 100. This cage 134 defines, at the front (that is to say on the side of its free end), the said shoulder 130 on which bears the fork 105 when the working member 100 is driven towards the front of the mounting. The shoulder 106, on which the fork 105 bears when the rod is extracted is, for its part, machined into the rotary member 136, so as to free the spindle 138 from any traction force during the disengagement of the piercing rod 54 from the taphole.

It will be noted that the means represented in FIG. 8 for securing the piercing rod 54 to the coupling 102, comprise a male screw thread 140, machined into the free end of the piercing rod 54, and a corresponding female screw thread machined into the front end of the rotary member 136.

FIGS. 10, 11, 12 and 13 show a variant using a clamp with jaws 150 for extracting the piercing rod 54. This clamp with jaws 150 is integrated into the first carriage 32, onto which the finger 42 is articulated. It will be noticed that the clamp with jaws 150 must be fitted with a passageway 152 for the piercing rod 54, which is sized so as to allow the passage of the guide means during the operation of inserting the piercing rod 54 with the aid of the finger 42 (see FIGS. 10 and 11). In this way, the clamp with jaws 150 may remain in place on the carriage 32 during the operation of inserting the piercing rod 54 into the taphole clay. During the extraction of the piercing rod 54, the guide means 68, 70 are, of course, moved away from the trajectory of the clamp, and the finger 42 is folded upwards (see FIGS. 12 and 13). The rod may now be gripped firmly by the pairs of jaws 154 arranged along the passageway 152.

Figure 16:
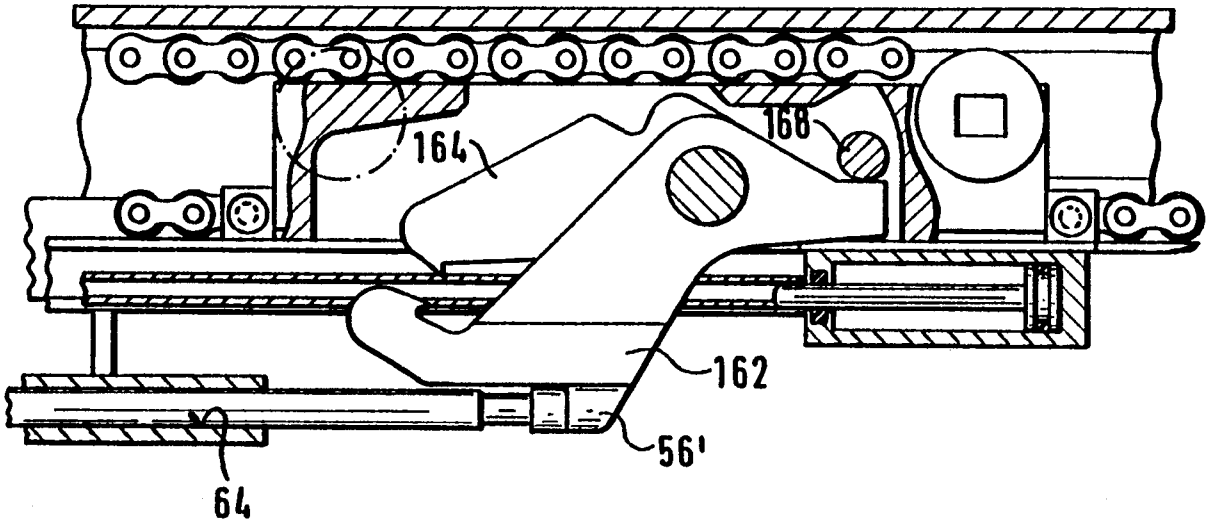

FIGS. 14, 15, 16 and 17 show a variant using, for extracting the piercing rod 54, a clamp 160 formed from two hooks 162 and 164 which are juxtaposed and both articulated about a transverse pin 166 in the said first carriage 32. Before describing the operation for extracting the piercing rod 54 with the aid of the two hooks 162 and 164, it will be noted that the hook 162 includes, at its lower end, a heel 56' equivalent to the said cylindrical heel 56 of the finger 42. This heel 56' may penetrate into the guide channel 64 so as to bear on the free end of the piercing rod 54 in order to thrust the piercing rod 54 into the taphole clay. The hook 162, consequently, during the operation for inserting the piercing rod 54 into the taphole clay, fulfills the role of the finger 42 represented in FIGS. 4 and 5. In FIG. 16, it can be seen that for the operation of inserting the rod, the two hooks 162 and 164 are blocked by a removable stop 168 in a folded down position. In this position, the cylindrical heel 56' is aligned with the guide channel 64, and the hook 164 is completely folded down into the carriage 32. The removable stop 168 at the same time constitutes a backing support for the hook 162, when the cylindrical heel 56' of the hook 162 bears on the end of the piercing rod 54 so as to exert an axial thrust on the piercing rod 54.

For disengaging the piercing rod 54, the means defining the guide channel 64 are folded down (see FIG. 14) and the removable stop 168 is removed, so that the hooks 162 and 164 may be engaged behind a shoulder 170 integral with the free end of the piercing rod 54. It will be noticed that the hook 162 is blocked in this position by a removable transverse rod 172.

A pneumatic jack 174, integral with the first carriage 32 thrusts the hook 162 against the piercing rod 54 and thus closes the clamp 160 behind the shoulder 170. The second hook 1(>4 is thrust against the transverse rod 172 which consequently serves as a backing support or as a reaction element for the clamp 160. It will be noted that the ends of the two hooks 162 and 1(>4 advantageously have the form of annular segments circumferentially matching the piercing rod 54, so as to increase the contact surface between the clamp 160 and the piercing rod 54, and thus to reduce the risk of tearing out the shoulder 170 as the piercing rod 54 is disengaged from the taphole.

Figure 6:
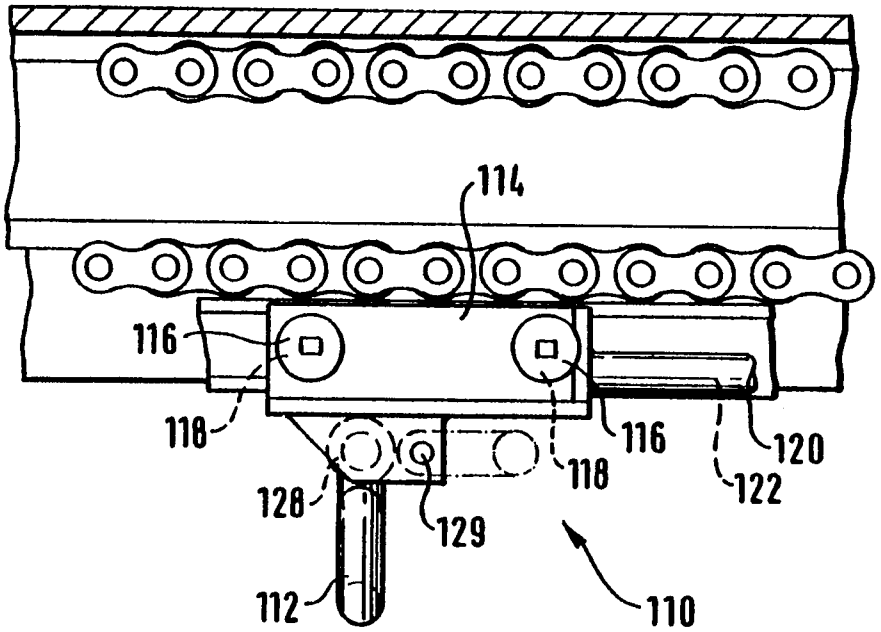
FIG. 6 shows a section through a carriage supporting an intermediate support on the mounting.
Figure 7:
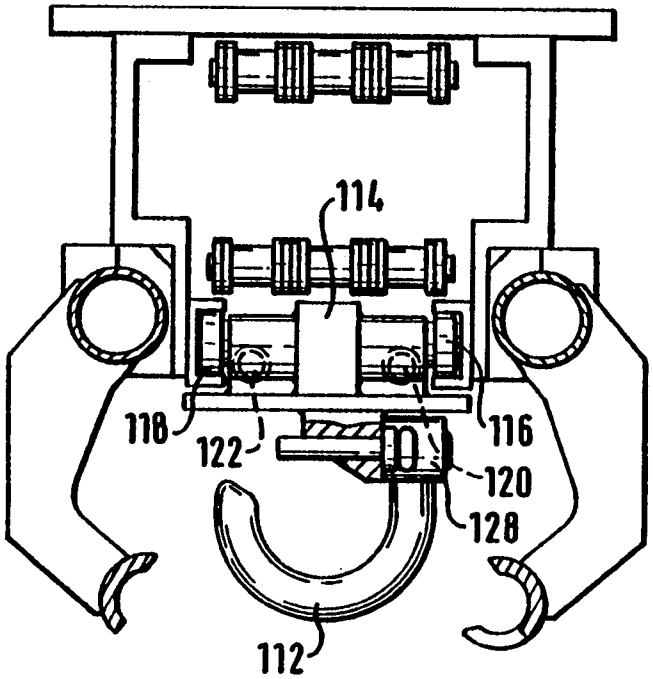
FIG. 7 shows, in a transverse section through the machine according to FIG. 1, the assembly, in the mounting, of the carriage supporting the intermediate support.

In order to be able to work without a guide channel 64, the mounting 10 includes an intermediate support 110 (see FIGS. 6 and 7). This intermediate support is made up of a hook 112 mounted on a third carriage 114 sliding with the aid of two pairs of rollers 116, 118 in the same rails 110, 112 as the working tool 100 (see FIGS. 6 and 7). This carriage 114 is preferably linked to the first carriage 32 by means of two rods 120, 122 which are fixed to the third carriage 114 and which slide in guide bushings 124, 126 (see FIG. 4) of the first carriage 32 and of the working member 100. The object of these rods 120, 122 is to withdraw the intermediate support 110 automatically from the front of the mounting towards the middle of the mounting, to bring it to safety before the piercing rod 54 is completely withdrawn from the taphole. This same support 110 may, however, also be useful for mounting/removing a drill bit on the working member. When working with the guide channel, the hook 113 of the intermediate support 110 is folded upwards so as not to hinder the installation of the said guide means 68, 70. To this end the hook 113 is mounted on the carriage 114 with the aid of a cylindrical articulation 128 and may be immobilized in the folded position by a small pin 129, or by an equivalent means respectively.

A fixed support 130 at the front of the mounting is preferably a support screen of the type proposed in the European Patent Application EP 0,064,644. The latter includes two flaps mounted at the front of the mounting 10, that is to say facing the taphole when the mounting is in the operative position. These flaps may pivot between an open position, facilitating the grasping of the piercing rod 54 for disengaging the piercing rod 54 from the taphole. The second closed position, defines a support for the rod 54 and a protective shield against splashes coming from the jet leaving the taphole when the taphole is open.

It will be noted that the piercing machine in accordance with the present invention may also be produced with drive means other than a hydraulic motor driving an endless chain. For example, various types of jacks, inter alia a telescopic jack or jack of stroke C which acts on the carriage 32 by means of a stroke multiplier so as to displace it over a distance 2C along the mounting may be used. Another possible drive system is a screw-nut system, in which the nut is rotationally fixed and the screw which extends along the mounting is translationally fixed. A rotation of the screw consequently drives the translation of the nut. This nut may directly support the finger 42 or may well drive the first carriage 32 supporting the finger 42.

It will be appreciated that the finger 42 does not necessarily have to be mounted on a carriage 32 which slides in rails in the box structure 14 forming the mounting 10. Any guide means making it possible to keep the finger 42 in the axis of the rod 54 when it is displaced along the mounting should be considered as a perfectly equivalent means to the carriage/rail system of the present invention. In certain cases it is even possible to envisage the finger 42 being directly mounted on the drive means itself. In these cases it is perfectly within the spirit of the present invention to give the first carriage 32 the means used for securing the finger 42 to the said drive means. In the sense of the present invention, the term "carriage" consequently denotes, in the most general way, a machine component which supports and displaces another machine element.

It will also be noted that the embodiment of the guide means, such as described hereinabove, is only a preferential embodiment. It is perfectly possible to provide other solutions which make it possible to define a guide channel 64 for the metal rod 54 coaxial to the axis of the taphole, and into which the finger 42 may penetrate so as to thrust the rod 54 into the taphole clay, without in any way departing from the teaching of the present invention. Moreover, the foregoing applies to the support means for supporting the guide means.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A machine for piercing a taphole in a wall of a shaft furnace, using a method in which, after having plugged the taphole with a taphole clay, a piercing rod is driven into this clay, before it has fully hardened, and it is extracted, at the appropriate time in order to open the taphole, the machine comprising:

mounting means which can be oriented in front of the wall of the shaft furnace in a working position in the extension of the axis of the taphole;

first carriage means which can be displaced along said mounting means;

drive means for driving said first carriage means along said mounting means;

guide means for defining a guide channel for the piercing rod, said guide means having at least one longitudinal opening giving access to the inside of the guide channel perpendicularly to the axis of the guide channel;

support means for supporting said guide means on said mounting means wherein the longitudinal axis of the guide channel is coaxial with the axis of the taphole when said mounting means is located in said working position in front of the wall of the shaft furnace; and a finger integral with said first carriage means, said finger being sized so as to penetrate through said longitudinal opening to the inside of said guide channel and to be able to exert an axial pushing force on one end of the piercing rod during the advancement of said first carriage means in the direction of the taphole wherein said guide channel is sized so as to prevent the buckling of the piercing rod as the latter is driven into the taphole clay.

2. The device of claim 1, wherein said support means comprises arms articulated onto said mounting means so as to be able to pivot said guide means laterally out of a clearance space defined along said mounting means.

3. The device of claim 1 wherein said guide means includes a tube having a diameter which is slightly greater than that of the piercing rod and being fitted with at least one longitudinal slit passing radially through its wall along a generatrix along its entire length.

4. The device of claim 3 wherein said tube is split longitudinally into a first and second tube segment, and wherein said support means comprises first arms articulated along a first lateral side of said mounting means, which support said first segment of the tube, and second arms articulated along the opposite lateral side of said mounting means, which support said second tube segment, said first and second arms allowing the first tube segment and the second tube segment to pivot laterally from said mounting means in opposite directions.

5. The device of claim 2 including at least one jack actuating said support means so as to fold said guide means down into a lateral position with respect to said mounting means.

6. The device of claim 1 wherein the finger integral with said first carriage means can be pivoted about a pin which is perpendicular to the direction of displacement of said first carriage means, and including a stop, which is integral with said first carriage means, said stop comprising a backing support for the finger when the finger bears on the end of the piercing rod so as to exert an axial thrust on the piercing rod.

7. The device of claim 1 wherein said drive means comprises an endless chain tensioned along said mounting means, said chain being driven by a hydraulic motor.

8. The device of claim 1 including a working member sliding on and displaceable along said mounting means, and means for coupling said working member to said drive means of said first carriage means.

9. The device of claim 1 including fleeing means for fleeing the piercing rod from the taphole, said freeing means comprising means for coupling the end of the piercing rod to said drive means.

10. The device of claim 1 including:

a working member sliding on and displaceable along said mounting means between a front end and a rear end;

coupling means supported by said working member, for coupling said working member to a free end of a piercing rod engaged in the taphole, said coupling means being capable of transmitting a pulling force to said free end of said piercing rod;

pushing means connected to said drive means, said pushing means bearing directly on said coupling means for pushing the working member towards the rear end of said mounting means.

11. The device of claim 1 including fleeing means for fleeing the piercing rod from the taphole, said freeing means comprising at least one hook engaging a shoulder machined into the end of the rod.

12. The device of claim 1 including an intermediate support sliding on and displaceable along said mounting means to support a rod or piercing drill bit in the absence of the guide channel.

13. The device of claim 12, wherein the intermediate support comprises a hook mounted on a carriage with the aid of a cylindrical articulation so as to be able to be folded down.

14. The device of claim 1 including a screen mounted at the front of said mounting means facing the taphole, said screen comprising flaps capable of pivoting between an open position facilitating the grasping of the piercing rod with a view to freeing the piercing rod from the taphole, and a closed position in which said flaps define a support for the piercing rod at the front of the mounting, said screen also serving as a protection shield against splashes of molten metals.

15. The device of claim 1 wherein said first carriage means includes a clamp fitted with two juxtaposed hooks, which can be pivoted about a transverse axis and can be engaged behind a shoulder integral with the end of the piercing rod, and including at least one pneumatic jack, arranged between the first carriage and one of said two hooks, said jack having the ability to close and open the clamp pneumatically.

16. The device of claim 15, wherein one of said two hooks, includes a heel forming said finger which is capable of penetrating through said longitudinal opening inside of said guiding channel, and wherein said carriage means includes a removable stop forming, during the operation of inserting the rod into the taphole clay, a backing support for the hook including the heel.

17. The device of claim 1 wherein the first carriage means comprises a clamp with jaws, said clamp being fitted with a passageway for the piercing rod, said passageway being sized so as to allow the passage of said guide means during the operation for inserting the piercing rod into the taphole with the aid of the finger.

18. A machine for piercing a taphole in a wall of a shaft furnace using a method in which, after having plugged the taphole with a taphole clay, a piercing rod is driven into this clay, before it has fully hardened, and it is extracted, at the appropriate time in order to open the taphole, the machine comprising:

mounting means which can be oriented in front of the wall of the shaft furnace in a working position in the extension of the axis of the taphole;

first carriage means which can be displaced along said mounting means;

drive means for driving said first carriage means along said mounting means;

tube means defining a channel for receiving a piercing rod, said tube means having an inner section which is slightly greater than the cross section of the piercing rod and at least one longitudinal slit extending axially through said tube means; and a finger integral with said first carriage means, said finger being sized so as to penetrate through said longitudinal slit and to be able to exert an axial pushing force on one end of the piercing rod within said tube means.

* * * * *